US011077545B2

(12) United States Patent
Christen et al.

(10) Patent No.: US 11,077,545 B2
(45) Date of Patent: Aug. 3, 2021

(54) TOOL STORAGE DEVICE

(71) Applicant: Robert Bosch GmbH, Stuttgart (DE)

(72) Inventors: Stefan Christen, Langendorf (CH); David Steinlin, Solothurn (CH); Simon Isch, Bern (CH)

(73) Assignee: Robert Bosch GmbH, Stuttgart (DE)

( * ) Notice: Subject to any disclaimer, the term of this patent is extended or adjusted under 35 U.S.C. 154(b) by 293 days.

(21) Appl. No.: 16/304,775

(22) PCT Filed: Apr. 4, 2017

(86) PCT No.: PCT/EP2017/057919
§ 371 (c)(1),
(2) Date: Nov. 27, 2018

(87) PCT Pub. No.: WO2017/207136
PCT Pub. Date: Dec. 7, 2017

(65) Prior Publication Data

US 2020/0324399 A1 Oct. 15, 2020

(30) Foreign Application Priority Data

May 31, 2016 (DE) ..... 10 2016 209 490.4

(51) Int. Cl.
*B25H 3/00* (2006.01)
*B25H 3/02* (2006.01)

(52) U.S. Cl.
CPC ..... *B25H 3/003* (2013.01); *B25H 3/022* (2013.01)

(58) Field of Classification Search
CPC ..... B25H 3/003; B25H 3/022
(Continued)

(56) References Cited

U.S. PATENT DOCUMENTS 5,570,784 A * 11/1996 Sidabras ..... B25H 3/003 206/378
6,626,295 B1 9/2003 Vasudeva
(Continued)

FOREIGN PATENT DOCUMENTS

DE 36 01 230 A1 8/1987
DE 698 06 605 T2 1/2003
(Continued)

OTHER PUBLICATIONS

International Search Report corresponding to PCT Application No. PCT/EP2017/057919, dated Jul. 19, 2017 (German and English language document) (6 pages).

*Primary Examiner* — Jacob K Ackun
(74) *Attorney, Agent, or Firm* — Maginot, Moore & Beck LLP

(57) ABSTRACT

A tool storage device for storing application tools and/or assembly aids includes at least one plug-in member and at least one storage housing. The plug-in member is configured to retain application tools or assembly aids. The storage housing includes a receiving region for releasably fastening the plug-in member to the storage housing. The plug-in member has a first retaining end connected to the receiving region of the storage housing, and a second retaining end connected to the receiving region of the storage housing, in order to secure the plug-in member in a form-fitting manner with respect to at least a first direction. The plug-in member is connected to the storage housing such that the plug-in member is mounted, in particular clamped in place, firmly, in particular in a play-free manner, in at least a second direction on the storage housing.

15 Claims, 9 Drawing Sheets

(58) Field of Classification Search
USPC ..... 206/376, 379, 378
See application file for complete search history.

(56) References Cited

U.S. PATENT DOCUMENTS 7,322,470 B2 * 1/2008 Brunson ..... B25H 3/003 206/372
7,600,640 B2 * 10/2009 Hallee ..... B25H 3/003 206/373
7,931,143 B1 * 4/2011 Lin ..... B25H 3/021 206/373
8,069,984 B2 * 12/2011 Larson ..... B25H 3/003 206/377
2002/0070185 A1 * 6/2002 Chen ..... B25H 3/04 211/70.6
2002/0117413 A1 * 8/2002 Ling ..... B25H 3/02 206/373
2004/0069668 A1 * 4/2004 Finnigan ..... B25H 3/003 206/372
2005/0241974 A1 * 11/2005 Chen ..... B25H 3/003 206/379
2006/0169613 A1 * 8/2006 Roesler ..... B25H 3/003 206/379
2006/0186007 A1 * 8/2006 Dost ..... B25H 3/003 206/379
2006/0201835 A1 9/2006 Shih
2016/0052125 A1 * 2/2016 Steele ..... B25H 3/021 206/372

FOREIGN PATENT DOCUMENTS

DE 20 2008 009 244 U1 11/2008
DE 20 2015 104 503 U1 11/2015
GB 2 470 011 A 11/2010

* cited by examiner

Section A-A

Section B-B

TOOL STORAGE DEVICE

This application is a 35 U.S.C. § 371 National Stage Application of PCT/EP2017/057919, filed on Apr. 4, 2017, which claims the benefit of priority to Serial No. DE 10 2016 209 490.4, filed on May 31, 2016 in Germany, the disclosures of which are incorporated herein by reference in their entirety.

The disclosure relates to a tool storage device, in particular a tool storage box, for storing application tools and/or installation aids, comprising at least

- one plug-in means for holding application tools or installation aids and
- one storage housing with a receiving region for the releasable fastening of the plug-in means to the storage housing, wherein the plug-in means comprises a first holding end, which is connected, in particular at least in part in a positive locking manner, to the receiving region of the storage housing, and a second holding end, which is connected, in particular at least in part in a positive locking manner, to the receiving region of the storage housing in order to secure the plug-in means in a positive locking manner in relation to at least one first direction.

BACKGROUND

U.S. Pat. No. 6,626,295 B1 discloses a tool case with an additional storage container which is accessible from an interior of the tool case, the storage container being able to be attached by means of a snap mechanism in or on the tool case and serving for the purpose of providing additional stowage possibilities for diverse small parts. The storage container comprises a clamping arm with a clamping recess which forms a connection to the tool case and is provided for the purpose of securing the storage container against unwanted release from the tool case.

SUMMARY

The object underlying the disclosure is to improve a tool storage device for storing application tools and/or installation aids using simple structural measures.

The object is achieved with a tool storage device, in particular a tool storage box, for storing application tools and/or installation aids, comprising at least

- one plug-in means for holding application tools or installation aids and
- one storage housing with a receiving region for the releasable fastening of the plug-in means to the storage housing.

The plug-in means comprises a first holding end, which is connected, in particular at least in part in a positive locking manner, to the receiving region of the storage housing, and a second holding end, which is connected, in particular at least in part in a positive locking manner, to the receiving region of the storage housing in order to secure the plug-in means in a positive locking manner in relation to at least one first direction.

According to the disclosure, the plug-in means, in particular the first holding end and the second holding end of the plug-in means, is connected in such a manner to the storage housing that the plug-in means is mounted, in particular clamped, on the storage housing in a fixed manner, in particular in a play-free manner, in at least one second direction.

The advantage in particular here is that the plug-in means is fixedly connected to the storage housing and is secured against independent release. There is also the advantage that the plug-in means is clamped in particular in relation to the storage housing and consequently there is a non-positive locking connection, which mounts the plug-in means, in particular in a play-free manner, in addition to the positive locking connection between the plug-in means and the storage housing.

In addition, a plug-in means which is clamped in relation to the storage housing can be particularly advantageous for an operator of the tool storage device as the operator perceives a high-quality product as a result of haptic and acoustic feedback from an in particular pretensioned tool storage device, especially as the tool storage device, as a result of the pretension, in particular neither rattles nor assumes disproportionate-seeming deformation of the storage housing as a result, for example, of being pressed lightly by, for example, a finger of an operator. However, also, for example, should an in particular pretensioned tool storage device be inadvertently dropped, the acoustic of the impact of the storage device perceived by an operator will be more pleasant or more solid as an in particular pretensioned storage housing vibrates less strongly and consequently sounds more solid and quieter than a non-pretensioned storage housing.

In addition, as a result of the storage device according to the disclosure, it is possible to release the plug-in means from the storage housing in an advantageously simple manner by, for example, the positively connected second holding end being released such that the plug-in means can be removed with little effort out of the storage housing.

A pretensioned tool storage device, in particular a plug-in means and/or a storage housing, can be realized, in this case, by elastic deformation such as, for example, compressing or bending of the plug-in means and/or of the storage housing, which brings about a reversible change in the original dimensions of the plug-in means and/or of the storage housing. In particular, the plug-in means and/or the storage housing can deform in order to achieve pretension of the tool storage device.

The plug-in means can preferably be realized in one piece. In a preferred manner, the storage housing is to be realized in one piece. The term "in one piece" is to be understood in particular as connected in a substance-to-substance bond, like as a result of production from a casting and/or production using single-component or multi-component injection molding.

The term "tool storage device" is to be understood in this context, in particular, as a container which is used for storing application tools, such as, for example, drill tools and/or screwdriver bits, and/or mounting aids such as, for example, screws, dowels and/or nails. The application tools and/or the mounting aids, in this case, can be present in a range and in particular be in different sizes and have different application purposes.

The term "plug-in means" is to be understood as a means which is provided for receiving and for supporting application tools and/or mounting aids and additionally enabling a releasable connection to the receiving region of the storage housing. In a preferred manner, the plug-in means includes multiple receiving means for receiving multiple application tools and/or mounting aids. In a preferred manner, the receiving means of the plug-in means are arranged side by side in a plane. In particular, it is possible to provide multiple plug-in means which, for example, are arranged side by side in a plane and are connected to the tool storage device.

The term "fixedly connected" is to be understood in this context, in particular, as a connection which releasably and securely connects, in particular fastens, fixes or clamps, two bodies which are not connected together or are at least not structurally integral in a fastened state.

The term "releasable" is to be understood in this context, in particular, as "non-destructively separable".

The term "storage housing" is to be understood in this context, in particular, as a frame-shaped housing which, in a preferred manner, surrounds the plug-in means in an entire manner in at least in one plane. The preferred length of the storage housing is between 200 and 100 mm, particularly preferred between 170 and 160 mm, such as, for example, 165 mm. The preferred width of the storage housing is between 150 and 80 mm, particularly preferred between 120 and 100 mm, such as, for example, 110 mm. The preferred height of the storage housing is between 30 and 70 mm, particularly preferred between 45 and 60 mm, such as, for example, 40 or 50 mm. In particular, the storage housing can comprise a greater thickness than the plug-in means. The plug-in means can lie completely in a space spanned by the storage housing in a closed position. Protruding of application tools and/or of plug-in means can be avoided, as a result of which damage to the application tools and/or the plug-in means can be prevented. The storage housing is preferably designed in at least two parts and consists of a first storage housing and a second storage housing, which are connected together so as to be pivotable. The two storage housings can assume an open or a closed position such that, for example, in an open position both the application tools or the mounting aids and the plug-in means are able to be removed from the storage housing in a particularly simple manner.

The receiving region, in this case, forms a cavity which is entirely defined or surrounded by the storage housing in one plane. In particular, the receiving region is entirely surrounded by the storage housing with the tool storage device in a closed position.

As a result of the tool storage device according to the disclosure, the application tools and/or mounting aids are able to be removed quickly and simply out of the tool storage device in a particularly advantageous manner.

The term "play-free" is to be understood in this context, in particular, as the plug-in means being connected to the storage device in at least one fastened state in such a manner that contact exists between the plug-in means and the storage device in at least one direction. In particular, in this case, the plug-in means and/or the storage device are to be pretensioned such that the plug-in means and/or the storage device achieve elastic deformation in relation to an initial dimension in at least one direction in order to generate, for example, a counter force which is dependent on a change in the extent, is preferably proportional to the change and acts counter to the change. In a preferred manner, the counter force is provided for the purpose of generating a play-free bearing arrangement of the plug-in means in or on the storage device. In particular, a play-free connection can be effected as a result of an interference fit or a press fit by, for example, the clamping means comprising a larger extent than the receiving region of the storage device provided for receiving the plug-in means. As a result, the plug-in means can be compressed, for example, in order to fit into the receiving region provided for the plug-in means.

A corresponding change in length of the plug-in means and/or of the storage device is to be able to be applied as a result of a force using, for example, a finger of an operator onto the plug-in means.

In particular, the plug-in means and/or the storage housing include plastics material or consist of plastics material.

The term a "second direction" is to be understood in this context as a direction which are understood along a main extension direction of the plug-in means which provides, in particular the length of the plug-in means.

The term a "first direction" is to be understood in this context as a direction which is angled, in particular, at an angle within a range of between approximately 85° and 95°, in particular within a range of between 88° and 92°, to the second direction and in particular reproduces the depth of the plug-in means. In particular, this can also refer to a direction which extends perpendicularly or at a right angle to the second direction of the plug-in means.

The term a "third direction" is to be understood in this context as a direction which is angled, in particular at an angle within a range of between approximately 85° and 95°, in particular within a range of between 88° and 92°, to the first direction and/or to the second direction and in particular reproduces the width of the plug-in means.

In particular, this can also refer to a direction which extends perpendicularly or at a right angle to the first direction and/or second direction of the plug-in means.

The subclaims specify expedient further developments of the tool storage device according to the disclosure.

It can be expedient for the plug-in means to include elastic material or to consist of elastic material, wherein the plug-in means is provided for the purpose of becoming deformed at least in part at least in the second direction and of mounting, in particular clamping, the plug-in means in the receiving region in a fixed manner, in particular in a play-free manner. As a result, the storage housing can be realized in a particularly sturdy manner in order to enable an advantageously robust or sturdy connection between the plug-in means and the storage housing.

In particular, the plug-in means can be elastically modifiable in a normal operating state by up to 5%, in particular by up to 3%, preferably by up to 2%, in a preferred manner by up to 1%, particularly preferred by up to 0.5%, in particular can achieve a corresponding modification of the extent in relation to an initial dimension and in particular can generate a counter force, which is dependent on a modification of the extent, is preferably proportional to the modification and acts counter to the modification.

The plug-in means and/or storage device can be elastically modifiable in a normal operating state by up to 7%, in particular by up to 5%, preferably by up to 3%, in a preferred manner by up to 2%, particularly preferred by up to 1%, such as for example 2.8%. In this case, the storage device can comprise an e-modulus of approximately between 500 and 7000 MPa, in particular of approximately between 1500 and 3100 MPa, preferably of approximately 2300 MPa. In this case, the plug-in means can comprise an e-modulus of approximately between 300 and 5000 MPa, in particular of approximately between 1000 and 2000 MPa, preferably of approximately 1460 MPa.

The term "elastic material" is to be understood in particular as a material which is repeatedly deformable without the material being mechanically damaged or destroyed as a result, and which automatically strives for a basic form again after deformation.

The term "provided" is to be understood, in particular as specially programmed, designed and/or equipped. An object being provided for a particular function is to be understood, in particular, as the object fulfilling and/or carrying out said particular function in at least one application and/or operating state.

In addition, it can be expedient for the second holding end of the plug-in means to be arranged on a side of the plug-in means remote from the first holding end and to comprise a stop geometry, in particular a stop elevation, which extends in the first direction and is provided for the purpose of mounting, in particular clamping, the plug-in means in a fixed manner, in particular in a play-free manner, in at least the second direction in a fastened state connected to the receiving region of the storage housing. In this case, the stop geometry can extend in the first direction in order to increase the extent of the plug-in means in at least the first direction.

In addition, it can be expedient for the storage housing to include elastic material or to consist of elastic material which is provided for the purpose of becoming deformed at least in the second direction and of mounting, in particular clamping, the plug-in means in the receiving region in a fixed manner, in particular in a play-free manner. As a result, the plug-in means can be realized in a particularly sturdy manner in order to enable an advantageously robust or sturdy connection between the plug-in means and the storage housing. In particular, the plug-in means and the storage housing can include an elastic material or can consist of an elastic material such that elastic deformation of both the plug-in means and of the storage housing is made possible in order to tension the plug-in means and the storage housing.

The elastic material of the storage housing can preferably comprise an e-modulus which is smaller than the e-modulus of the plug-in means. As a result, a particularly simple connection, in particular consisting of non-positive locking and/or frictional locking, is generated between storage housing and plug-in means.

Furthermore, it can be expedient for the receiving region of the storage housing and/or the plug-in means to comprise a first latching geometry, in particular an elastic latching tongue which is provided for the purpose of releasably connecting, in particular latching, the plug-in means to the receiving region in at least the first direction. This is particularly advantageous for an operator of the tool storage device as the operator, when latching the plug-in means in the storage housing, obtains a secure positive locking connection in at least the first direction X and, additionally, particularly advantageous feedback in the form of an acoustic sound, such as, for example, a latching-in or a clicking, or a haptic impression and consequently can be sure that the plug-in means is fixedly connected to or latched to the storage housing.

In particular, the latching geometry simply assumes a latching connection in the first direction and secures the plug-in means correspondingly in the first direction.

The term "latching geometry" is to be understood as a geometry of at least one latching element which realizes a latching device at least in part in a contrary manner to a further latching geometry which corresponds with the geometry and is provided, in particular, for the purpose of enabling non-stepless adjustment or securement against falling out.

The term "latching device" is to be understood, in particular, as a device which includes at least two latching elements, the at least two latching elements being displaceable or rotatable relative to one another and being provided, in at least one position, for the purpose of preventing a movement, in particular a rotary movement, or of counteracting a movement and, in particular, in at least one further position, of enabling a movement, in particular a rotary movement. The latching elements, in this case, are elastically deflectable in order then to latch in behind a corresponding latching element as a result of an inner resilience. In particular, the latching device is not realized in a stepless manner.

The latching geometry, in particular the latching elements, are not to be provided for the purpose of tensioning the plug-in means with the storage housing in at least the second direction but simply to secure the plug-in means in at least the first direction in the fastened state. Tensioning the plug-in means with the storage housing in the second direction would, amongst other things, have a negative effect on the functioning of the latching geometry and could consequently not ensure simple removal of the plug-in means out of the storage housing as the latching geometry requires elevated force expenditure to release the plug-in means from the storage housing.

It is proposed that the receiving region comprises a guide device which is provided for the purpose of exerting a constraint force onto the plug-in means, in particular the stop geometry of the plug-in means, in order to provide movement of the plug-in means in at least the second direction Y when guiding the plug-in means from a release state into a fastened state. As a result, amongst other things, it can be ensured, having regard to the disclosed teaching of poka-yoke, that the plug-in means is only connected in a direction, on a side and at an angle provided for the connection of the plug-in means to the storage device such that an operator of the tool storage device immediately knows intuitively how he has to align the plug-in means in order to obtain the necessary connection between plug-in means and storage device.

The term "guide device" here is in particular intended to define a device which is provided for the purpose of exerting a constraint force at least along a direction perpendicularly to a contact point or a contact surface between the plug-in means and the tool storage device in order to provide movement possibility for the plug-in means along the storage region of the tool storage device. The term "constraint force" here is in particular intended to define a force which is provided for the purpose of impeding a body moving in at least one direction and/or of holding the body during a movement along a path provided by means of an effect of the force on the body.

It is further provided that the guide device surrounds the first latching geometry in a plane through at least 30°, in particular through at least 90°, preferably through at least 180°, in order to protect the first latching geometry, in particular from an inadmissible load. In this case, the guide device can also serve as a protection element which surrounds the first latching geometry at least in part and protects the guide device against an inadmissible movement of the first latching geometry, in particular latching tongue, as a result of which it is possible to prevent the first latching geometry being inadmissibly loaded or even destroyed during handling. The guide device, in this case, can extend at least in part parallel to the first latching geometry and define a deflection of the first latching geometry in at least the second direction. In particular, the guide device can comprise a defining rib which extends substantially parallel to the first latching geometry or to the latching tongue and is provided for the purpose of serving as a stop for the first latching geometry with the first latching geometry in a deflected state. In a preferred manner, the guide device surrounds the first latching geometry in a U-shaped manner in at least one plane.

In particular, the guide device can comprise a guide wall which connects the two guide ribs. The guide wall can be arranged on a side of the first latching geometry remote from the second latching geometry. The guide wall can be realized in one piece with a side wall of the storage device.

It is further proposed that the guide device comprises at least one guide rib, in particular including at least one inclined guide rib surface or at least one inclined guide rib edge which defines a movement of the plug-in means in at least the second direction. The guide rib can comprise, in particular, at least one guide rib surface which extends substantially in the first direction and in the second direction and is provided for the purpose of defining a movement of the plug-in means in at least the third direction. In particular, the guide rib protrudes from a side wall of the storage housing in the second direction. The guide device preferably comprises two guide rib surfaces which are opposite one another and define a movement of the plug-in means in at least the third direction. In a preferred manner, at least one guide rib surface is arranged angled to a plane spanned by the third and the second direction in such a manner that a plug-in means sliding along the guide rib surface slides into a narrowing, realized in a wedge-shaped manner for example by the two guide rib surfaces, and, with the plug-in means in the fastened state, is clamped or braced in at least the third direction.

In particular, the guide rib surface can be realized in a flat manner and can be angled in relation to a plane, which is spanned from a second direction and a third direction, at an angle of up to 4°, in particular of up to 3°, preferably of up to 2°, such as, for example, 1.5°. The guide rib edge can preferably be angled in relation to a plane which is spanned from a first direction and a third direction at an angle of up to 10°, in particular of up to 8°, preferably of up to 6°, such as, for example, 5°.

The guide ribs are arranged, in particular, on a side which defines the receiving region of the storage device.

It can be expedient for the second holding end of the plug-in means to be arranged on a side of the plug-in means remote from the first holding end and to comprise a second latching geometry, in particular at least one latching rib, which extends substantially in the second direction Y and is provided for the purpose of latching the plug-in means, in particular the second holding end of the plug-in means, in relation to the first latching geometry of the storage housing in at least the first direction. An advantageously simple latching connection can be achieved as a result.

In addition, it can be expedient for the second holding end of the plug-in means to comprise a control geometry, in particular at least one control rib, which extends in a second direction Y and is provided for the purpose of positioning the plug-in means along the guide device. This ensures that the control rib is forcibly guided along the guide device, in particular the guide rib surface of the guide device, and assumes a clearly defined position in the receiving region of the storage device.

The control rib surface can comprise, in particular, at least one guide rib surface which extends substantially in the first direction and in the second direction and is provided for the purpose of defining a movement of the plug-in means in at least the third direction. The control rib surface preferably protrudes from a side wall of the storage housing in the second direction.

In a preferred manner, at least one control rib surface is arranged angled in such a manner to a plane which is spanned by the third and the second direction that a plug-in means sliding along the control rib surface slides into a narrowing, realized in a wedge-shaped manner for example by the two control rib surfaces, and, with the plug-in means in the fastened state, is clamped or braced in at least the third direction.

In addition, it can be expedient for the control rib to comprise a control elevation, in particular an elastic pretensioning elevation, which protrudes in the third direction and is provided for the purpose of mounting, in particular clamping, the plug-in means in the receiving region in at least the third direction in a fixed manner, in particular in a play-free manner. The control elevation preferably includes or consists of an elastic material such that the control elevation is able to deform in at least the third direction and to mount the plug-in means in at least the third direction in a play-free manner or to clamp it between the guide device.

Furthermore, it can be expedient for the first holding end of the plug-in means to comprise a holding tongue which defines the plug-in means in the second direction and is provided for the purpose of engaging in a recess in the receiving region of the storage housing and of defining a movement in at least the second and/or the third direction and, in particular, of clamping the plug-in means in the first direction. As a result, the first holding end of the plug-in means can be connected to the storage device in a particularly advantageous manner, in particular in a positive locking manner. The recess in the receiving region of the storage housing can be realized as a trough which extends in at least the second direction or as a notch in the storage housing and can be provided for the purpose of forming a positive locking and/or frictional locking connection to the plug-in means in at least the second and/or the third direction. The recess in the receiving region of the storage housing can be realized as an opening in the material which extends in at least the second direction and, in particular, breaks through the material thickness of the storage housing to an extent of 100% at least in the second direction.

It is proposed that the holding tongue is adapted, in particular by means of an interference fit, in such a manner to the recess in the receiving region that a force, in particular a pretensioning force, which acts at least in the first direction, is applied onto the plug-in means, in particular onto the holding tongue. In this case, the holding tongue can, for example, comprise an extent in the first direction which is smaller at least in part than an extent of the recess in the first direction. When the plug-in means, in particular the holding tongue, is inserted into the recess, the holding tongue can be compressed or squashed in the first direction in order to clamp the insertion means securely in the storage housing. As a result, in particular, a fixed and play-free connection is achieved between the plug-in means and the storage housing. The holding tongue can serve, in particular, as a positioning element which, for example during a plug-in operation of the plug-in means into the recess of the storage housing, engages in the recess of the storage housing and positions the plug-in means optimally for guiding purposes in the guide device of the storage housing. This is ensured, in particular, as a result of the holding tongue being realized in a flat manner and comprising a main extension in the second direction and in the third direction such that, for example, a rotation of the plug-in means about an axis pointing in the second direction is prevented by the recess and by the holding tongue inserted in the recess of the storage housing.

It is additionally proposed that the plug-in means comprises a pretensioning elevation which is provided for the purpose of applying a pretensioning force, which acts in the first direction, onto the holding tongue when the plug-in means is transferred from a release state into a fastened state.

The pretensioning elevation includes or consists of an elastic material such that the pretensioning elevation is able to deform in at least the first direction and mount the plug-in means in a play-free manner in at least the first direction or clamp it between the recess.

However, in principle, other realization variants which appear sensible to an expert are also possible.

BRIEF DESCRIPTION OF THE DRAWINGS

Further advantages are produced from the following description of the drawing. Exemplary embodiments of the disclosure are shown in the drawing. The drawings, the description and the claims contain numerous features in combination. The expert will also look at the features expediently on their own and will combine them to form sensible further combinations. The drawings are as follows:

DETAILED DESCRIPTION

Identical components are provided with identical reference symbols in the following figures.

The figures each relate to a tool storage device, in particular to a tool storage box, for storing application tools, such as, for example, drill tools and/or screwdriver bits, and/or mounting aids such as, for example, screws, dowels and/or nails. The tool storage device is realized in at least two parts and comprises at least one plug-in means and at least one storage housing which receives the plug-in means. The realization forms of the plug-in means can differ by, for example, plug-in means being provided for receiving application tools such as, for example, screwdriver bits, or plug-in means being provided for receiving installation aids, such as for example small parts or screws. However, other embodiments of plug-in means for receiving diverse other things are also conceivable but will not be discussed in any more detail.

Figure 1:
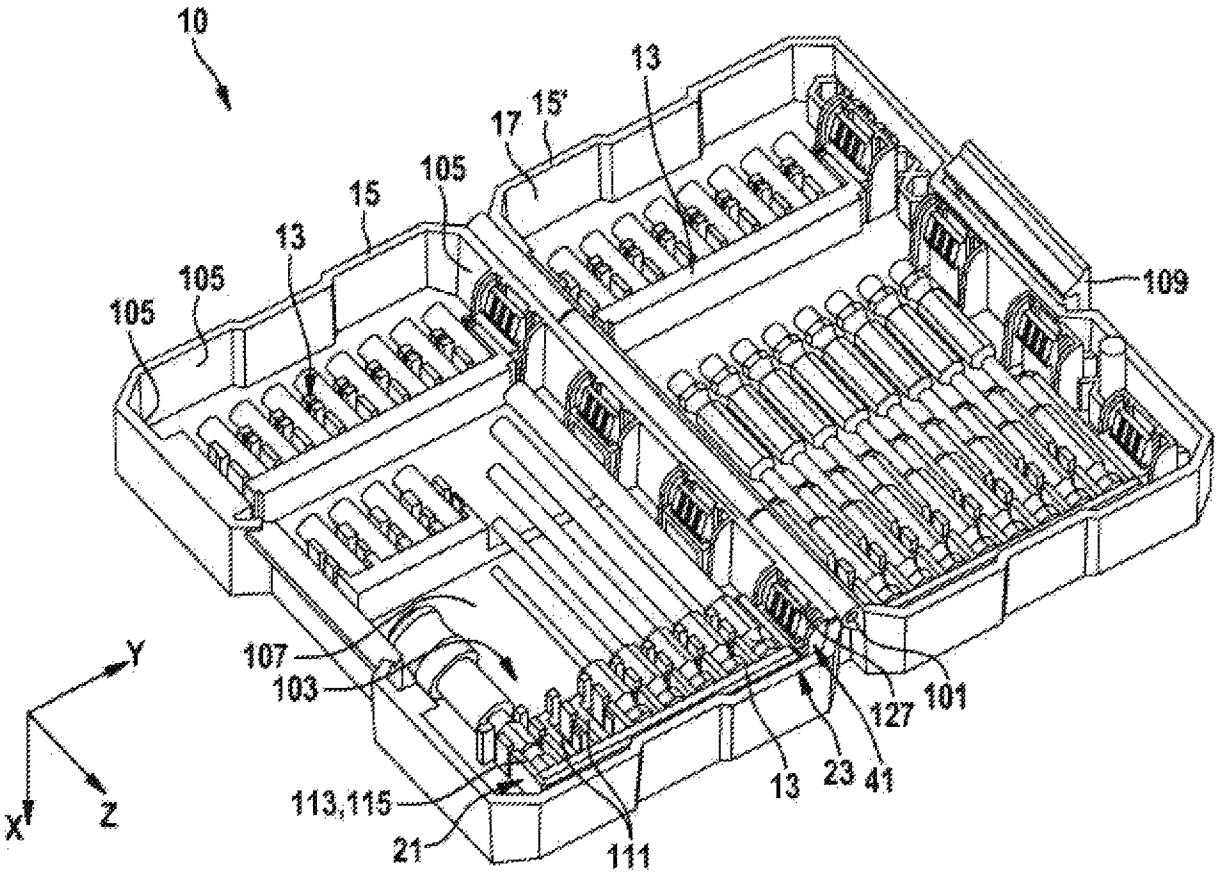
FIG. 1 shows a perspective view of a tool storage device according to the disclosure.
Figure 2:
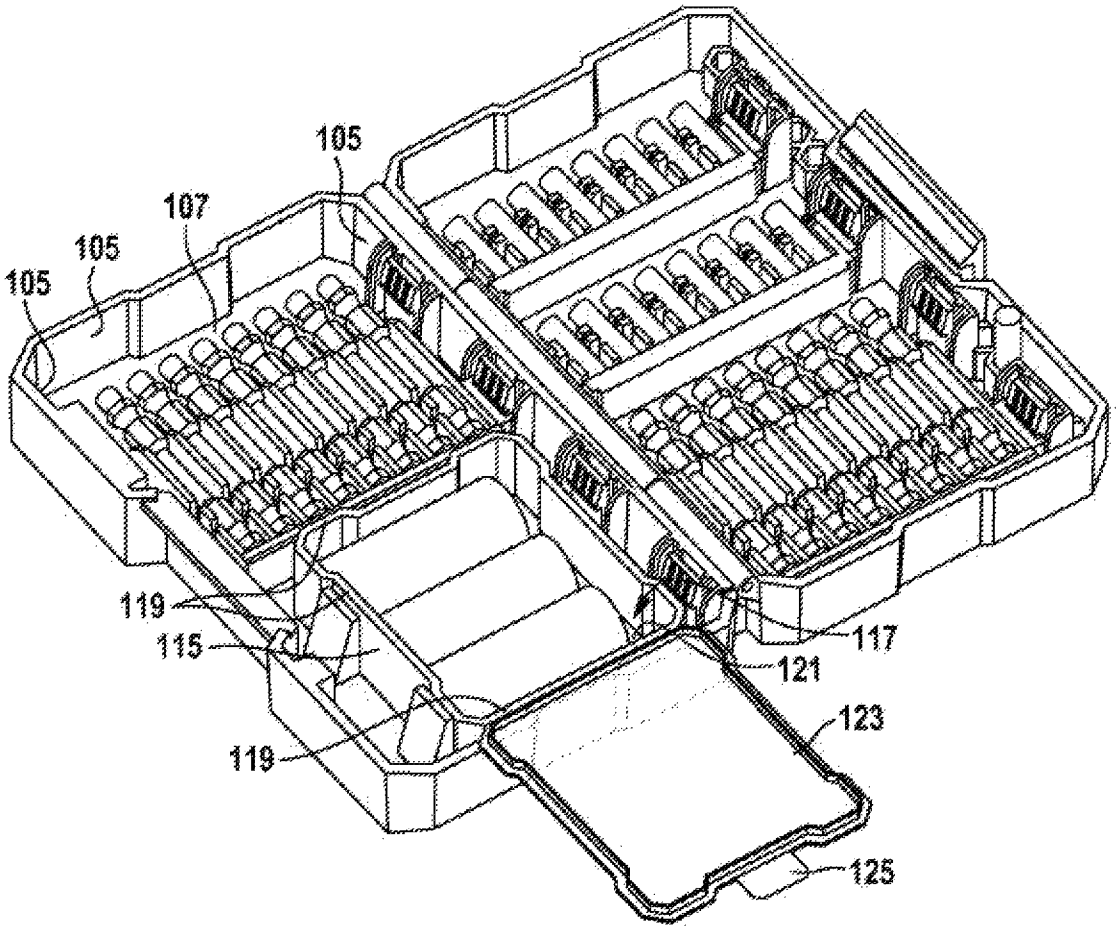
FIG. 2 shows a further embodiment of the tool storage device from FIG. 1.
Figure 3:
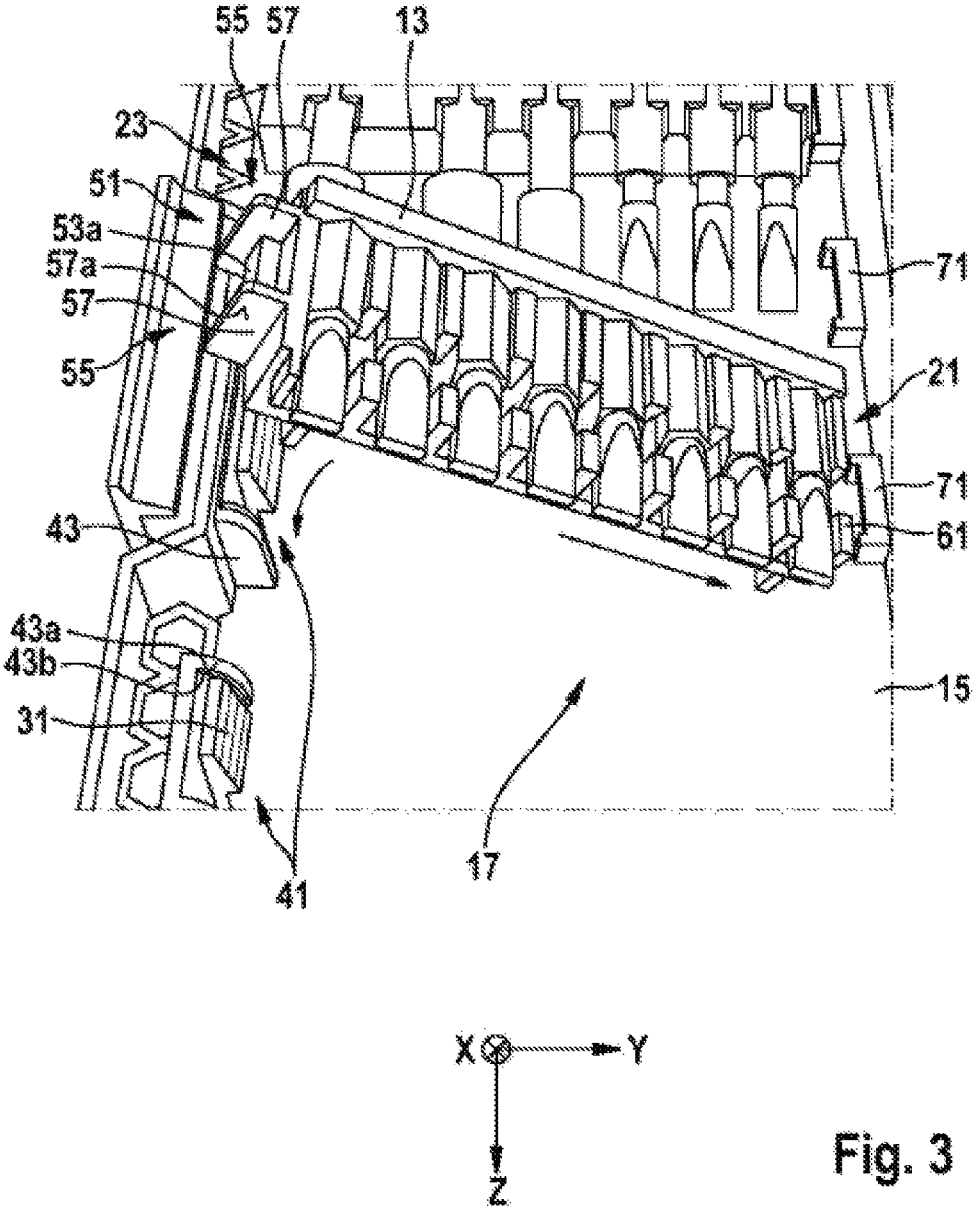
FIG. 3 shows a detail from the tool storage device according to the disclosure shown in FIGS. 1 and 2 having a first embodiment of a plug-in means.

FIGS. 1 to 3 show a tool storage device 10 with two storage housings 15, 15', which are pivotable and deflectable relative to one another, and multiple plug-in means 13 which are releasably connected to the storage device 10.

The phrase "pivotably mounted" is to be understood, in particular, as the storage housing 15 being connected to the basic body, in particular a further storage housing 15', so as to be movable about an axis, in particular a pivot axis. The pivoting movement of the two storage housings 15, in this case, is brought about, in particular, by a commercially available joint 101 in the form of, for example, a hinge.

The plug-in means 13 is realized in an oblong manner and comprises a main extension, which forms a length of the plug-in means 13, in a second direction Y, and a transverse extension, which forms a width of the plug-in means 13, in a third direction Z. An extension of the plug-in means 13 in a first direction X, in this case, forms a depth of the plug-in means 13.

The storage housing 15 is realized in a substantially cuboid form and comprises a main extension, which forms a length of the storage housing 15, in a third direction Z and a transverse extension, which forms a width of the storage housing 15, in a second direction Y. An extension of the storage housing 15 in a first direction X forms, in this case, in particular with the storage housing 15 in a closed state, a depth of the storage housing 15.

The storage housing 15 comprises a receiving region 17 which forms a cavity 103 and is provided for the purpose of providing a hollow volume for receiving application tools and/or installation aids. The cavity 103 is defined, in particular, by four side walls 105, which each form a first frame, and a bottom wall 107 which forms a lower boundary, such that the storage housing 15 is upwardly open on a side located opposite the bottom wall 107.

In said embodiment, a further storage housing 15', which is realized in particular in a substantially contrary manner to the storage housing 15, is connected to the storage housing 15 so as to be pivotable relative to the storage housing 15 and is provided for the purpose of defining the cavity 103 of the storage housing 15 with the tool storage device 10 in a closed state. In addition, on at least one side wall 105, the storage housing 15' comprises an, in particular positive locking, closure mechanism 109 which releasably connects the two storage housings 15, 15' when the tool storage device 10 is in a closed state.

In particular, the directions X, Y and Z of the storage housing 15 form a stationary coordinate system which is identical to a reference coordinate system of the plug-in means 13 at least in a fastened state such that the first, second and third directions X, Y and Z of the stationary coordinate system of the storage housing 15 represent the first, second and third directions X, Y and Z of the reference coordinate system at least in the fastened state. The reference coordinate system, in this case, can be rotated in relation to the stationary coordinate system of the storage housing 15 about at least the third direction Z or axis, in particular with the plug-in means 13 in a release state.

The first, second and third directions X, Y and Z are, in particular, perpendicular or orthogonal to one another. In this case, slight deviations, such as, for example, an angular deviation of up to 5%, in particular up to 4%, preferably up to 3%, preferred up to 2% and particularly preferred up to 1%, of the directions X, Y and Z are to lie within the framework of the technical knowledge and ability of an expert.

The plug-in means 13 includes an elastic material or consists of an elastic material. In particular, the entire plug-in means 13 is elastically deformable in at least the second direction Y. In a preferred manner, the plug-in means 13 is formed from a plastics material which has elastic characteristics and enables elastic deformation or a change in length within a range of between 98 and 99.5% in relation to an initial length of the plug-in means 13. As an alternative to this, other materials different from plastics material would also be possible.

In a preferred manner, the plug-in means 13 comprises multiple receiving means 111 for receiving application tools, such as, for example, drill tools or screwdriver bits, which are arranged, in particular, between the first holding end 21 and the second holding end 23. As an alternative to this or in addition to it, the plug-in means 13 includes multiple receiving means 111 for receiving installation aids. The receiving means 111 of the plug-in means 13 are arranged side by side in a plane. The receiving means 111 comprise at least one conventional positive locking element 113, in particular a positive locking arm, which secures the application tool against unintentional release from the receiving means 111 of the plug-in means 13. As an alternative to this or in addition to it, the receiving means 111 comprises a conventional non-positive locking element 115, in particular a spring arm, which is provided for the purpose of applying a holding force onto the application tool that is received in the receiving means 111. The application tools, in this case, are held, in particular in a positive locking manner, in the receiving means 111. It is possible, in particular, to provide multiple plug-in means 13 which are arranged, for example, side by side in a plane and are connected to the tool storage device 10.

The term "positive locking element" is to be understood in this context as at least one element such as, for example, a recess, in particular a ledge, a shoulder, a projection or a stop which interacts with at least one corresponding positive locking element. A positive locking connection consequently comprises two surfaces and/or edges which are contrary at least in portions and advantageously prevent one another from moving and realize a fixed seat for the positive locking elements in at least one direction X, Y, Z.

As an alternative to this, the plug-in means 13 can comprise, for example, a box 115 (FIG. 2) for receiving installation aids which is arranged, in particular, between the first holding end 21 and the second holding end 23. The box 115 can comprise, in particular, a cavity 117 which is defined by multiple, in particular four, side walls 119, a bottom wall 121 which connects the side walls 119 and a cover 123 which is pivotably connected to at least one side wall 119. The cover 123 comprises a closure 125 which is provided for the purpose of releasing or closing the cavity 117.

The plug-in means 13 comprises a first holding end 21 and a second holding end 23 which is remote from the first holding end 21. The plug-in means 13, in this case, is defined, in particular in the second direction Y by the first holding end 21 and the second holding end 23.

The first holding end 21 comprises a holding tongue 61 which extends in the second direction Y and defines the first holding end 21. The holding tongue 61 is realized in a flat manner and comprises a main extension in the third direction Z and protrudes in the second direction Y.

The second holding end 23 comprises a latching geometry 51, in particular a latching rib 53, which extends substantially in the third direction Z, protrudes in the second direction Y and is provided for the purpose of being latched to the storage housing 15 and securing the plug-in means 13 in a positive locking manner in the storage housing 15 in at least the first direction X.

The storage housing 15 comprises a first latching geometry 31 adjacent to at least one side wall 105. The first latching geometry 31 is realized as a flat latching arm 127 which extends in the third direction Z and protrudes from the bottom wall 107 in the first direction X. The latching arm 127 comprises, on a side of the latching arm 127 remote from the bottom wall 127, a latching shoulder 129 which protrudes in the second direction Y and is provided for the purpose of securing the latching rib 53 against release in the first direction X in a state connected in a positive locking manner to the latching arm 127. To this end, when the plug-in means 13 transfers from a release state into a fastened state, the latching arm 127 is bent elastically in a second direction Y in order to guide the latching rib 53 along at least part of the latching arm 127 and in a fastened state to transfer it again into the original position in a second direction Y which is opposite the second direction Y.

In particular, the storage housing 15 comprises a plurality of first latching geometries 31 which are provided for the purpose of receiving one plug-in means 13 in each case. Consequently, it is also possible to use different plug-in means 13 with, in particular, different forms and functions such that an operator can choose the corresponding plug-in means 13 according to what he wants. The first latching geometries 31 are arranged spaced apart from one another in the third direction Z.

As an alternative to this or in addition to it, the plug-in means 13 comprises a latching geometry which forms a latching arm which is not shown in any detail and is provided for the purpose of releasably connecting, in particular latching, the plug-in means 13 to the receiving region 17 of the storage housing 15 in at least the first direction X.

In a preferred manner, the storage housing 15 is formed from a plastics material which has elastic characteristics and enables elastic deformation or a change in length within a range of between 96 and 99% in relation to a starting length of the storage housing 15. As an alternative to this, other materials different to a plastics material would also be possible.

The second holding end 23 comprises a control geometry 55, in particular two control ribs 57, which extends substantially in the first direction X, protrudes in the second direction Y and is provided for the purpose of sliding along a guide device 41, in particular a guide rib 43 of the guide device 41, of the storage housing 15. As an alternative to this or in addition to it, it is possible to provide two guide ribs 43 which are parallel to one another and between which at least one control rib 57 is provided which defines a movement of the second holding end 23 in at least the third direction Z. As an alternative to this or in addition to it, it is possible to provide two control ribs 57 which are parallel to one another and between which at least one guide rib 43 is provided which defines a movement of the second holding end 23 in at least the third direction Z.

The control ribs 57 comprise a control rib surface 57*a* which is provided for the purpose of forming a sliding pair with a guide rib surface 43*a* of the guide device 41 such that the control rib surface 57*a* slides relative to the guide rib surface 43*a*. The guide rib surface 43*a*, in this case, extends in particular in a plane spanned by the first direction X and the second direction Y. The control surface defines a movement of the plug-in means 13, in particular of the second holding end 23, in relation to the guide device 41, in particular the guide rib 43, in the third direction Z.

Figure 4:
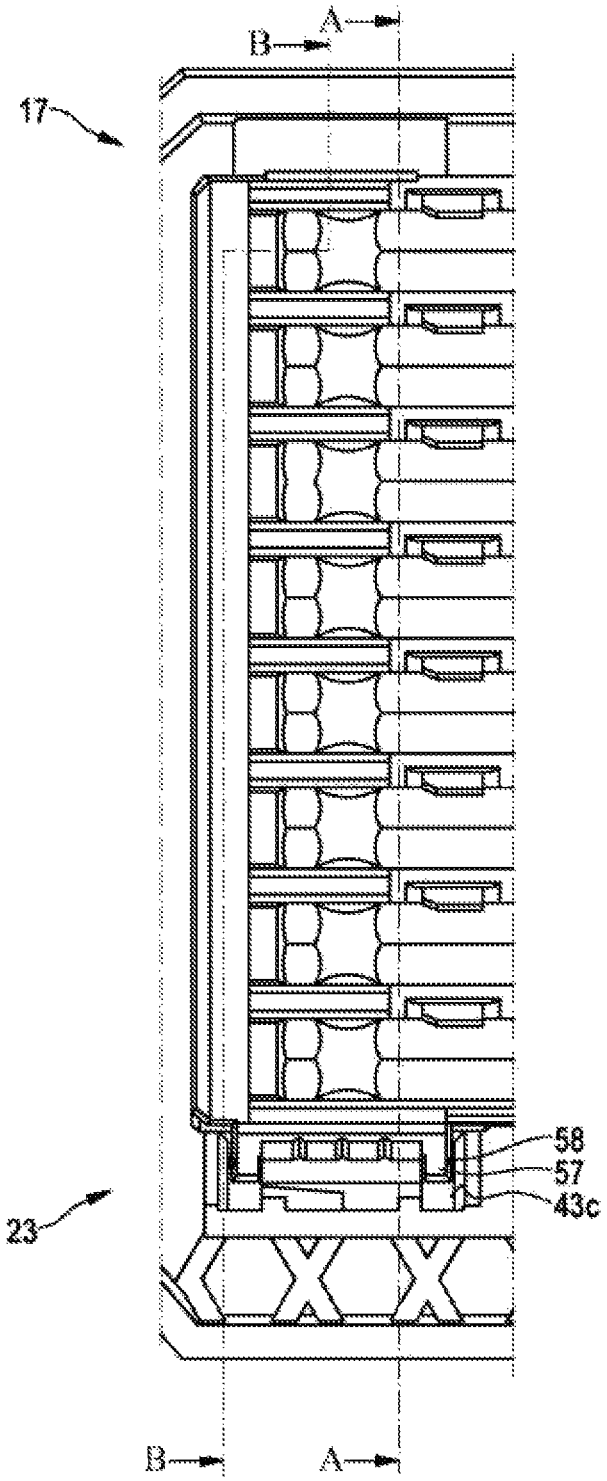
FIG. 4 shows a view of a further embodiment of the plug-in means in a storage housing.

FIG. 4 shows the plug-in means 13 in the receiving region 17 of the storage housing 15 in a fastened state. It is possible to see a plug-in means 13 with a storage housing 15 in a fastened state.

The two guide ribs 43, in this case, comprise in each case a guide chamfer 43*c* which is provided for the purpose of guiding the control ribs 57 in the guide device 41. In this case, the control ribs 57 are arranged in such a manner that the guide ribs 43 slide between two guide ribs 43 in a transition from the release state into the fastened state. In this case, the guide rib surfaces 43*b* of the respective guide ribs 43 are opposite the control rib surfaces 57*a* of the respective control ribs 57.

In addition, at least one control rib 57 comprises at least one control elevation 58 which is provided for the purpose of being elastically deformable at least in the third direction Z in order to mount, in particular to clamp, the second holding end 23, in particular the control ribs 57, between the two guide devices 41. The control elevations 58, in this case, extend in the first direction X and protrude in the third direction Z from the control rib surface 43*b* situated opposite a guide rib surface 43*a*. The control elevations 58 define the maximum extension of the control ribs 57 in the third direction Z.

In an alternative embodiment, at least one guide rib surface 43*b* can be angled in relation to the control rib surfaces 57*a* such that when the plug-in means 13 is transferred from a release state into a fastened state, a wedge-shaped connection is produced in at least the third direction Z of the second holding end 23 in the guide device 41 and consequently defines a movement of the plug-in means 13 in the third direction Z.

Figure 5:
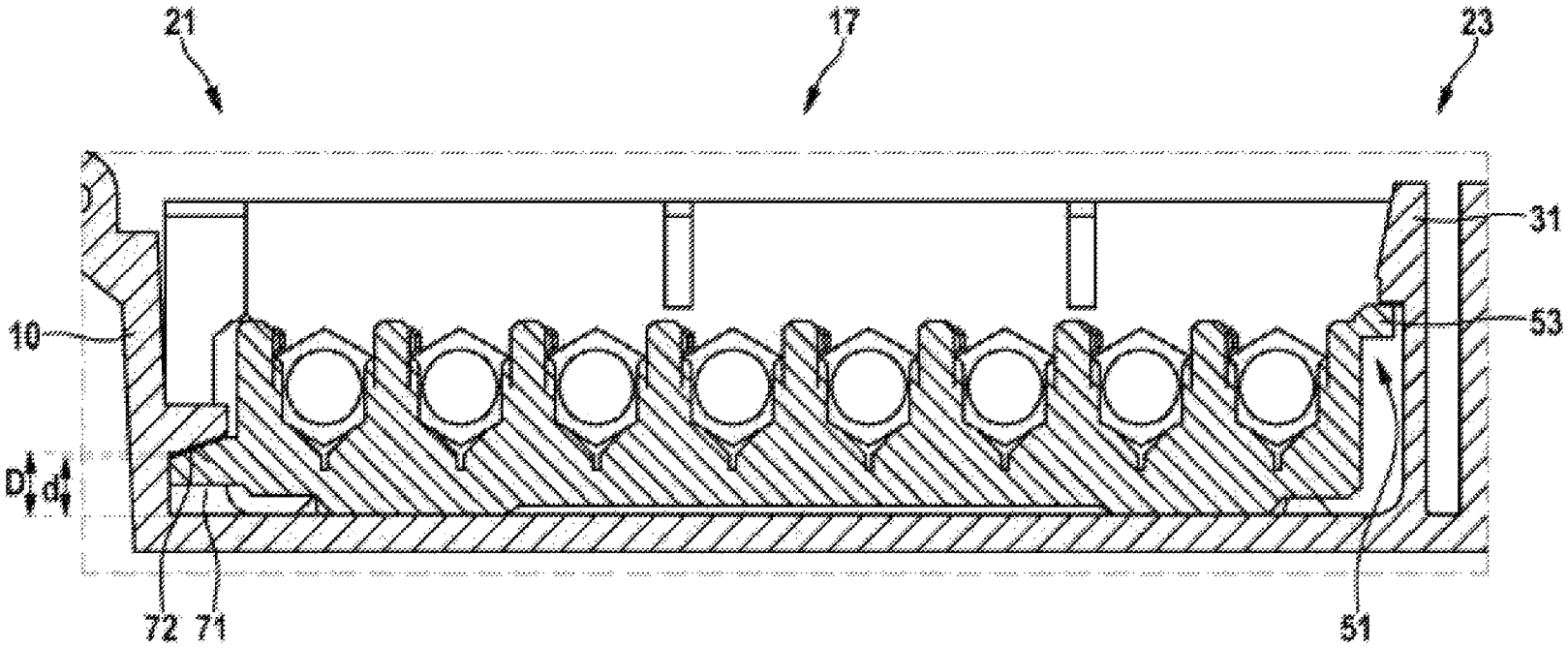
FIG. 5 shows a sectional view A-A of the plug-in means from FIG. 4.

FIG. 5 shows a section A-A through the plug-in means 13 and the storage housing 15 from FIG. 4. FIG. 5 shows a recess 71, in particular a trough, adjacent to a side wall 105 and a bottom wall 107 of the storage housing 15, which is provided for the purpose of receiving the first holding end 21, in particular the holding tongue 61, of the plug-in means 13 and holding it in a positive locking and/or non-positive locking manner in the storage device 10. In this case, the holding tongue 61 can be pretensioned in at least the first direction X by the holding tongue 61 comprising two pretensioning elevations 63 which extend in the third direction Z, protrude in the second direction Y and, with the plug-in means 13 in the fastened state, are elastically deformed in the storage housing 15 and pretension the plug-in means 13 in at least the first direction X.

The recess 71 extends, in this case, in the second direction Y and is entirely surrounded or defined in a plane that is orthogonal to the second direction Y in order to define, in particular, a movement of the holding tongue 61 in the first direction X and in the second direction Y. In particular, at least the bottom wall 107 forms a boundary to the movement of the holding tongue 61 in the recess 71. In a preferred manner, the recess 71 comprises a recess surface 72, which is opposite the bottom wall 107 and is realized transversely to the bottom wall 107 such that an extension of the recess 71 increases in at least the first direction X as the distance from the adjacent, in particular adjoining, side wall 105 of the recess 71 increases.

As an alternative to this or in addition to it, the recess 71 can comprise, in the first direction X, a minimum distance D which, in particular, characterizes a height of the recess 71 and the holding tongue 61 can comprise a minimum distance d, which characterizes a first height of the holding tongue 61, the distance D of the recess 71 being smaller than the distance d of the holding tongue 61 such that there is an interference fit between the distance D of the recess 71 and the distance d of the holding tongue 61. Consequently, the holding tongue 61 can be pretensioned in a fastened state at least in the first direction XYZ.

Figure 6:
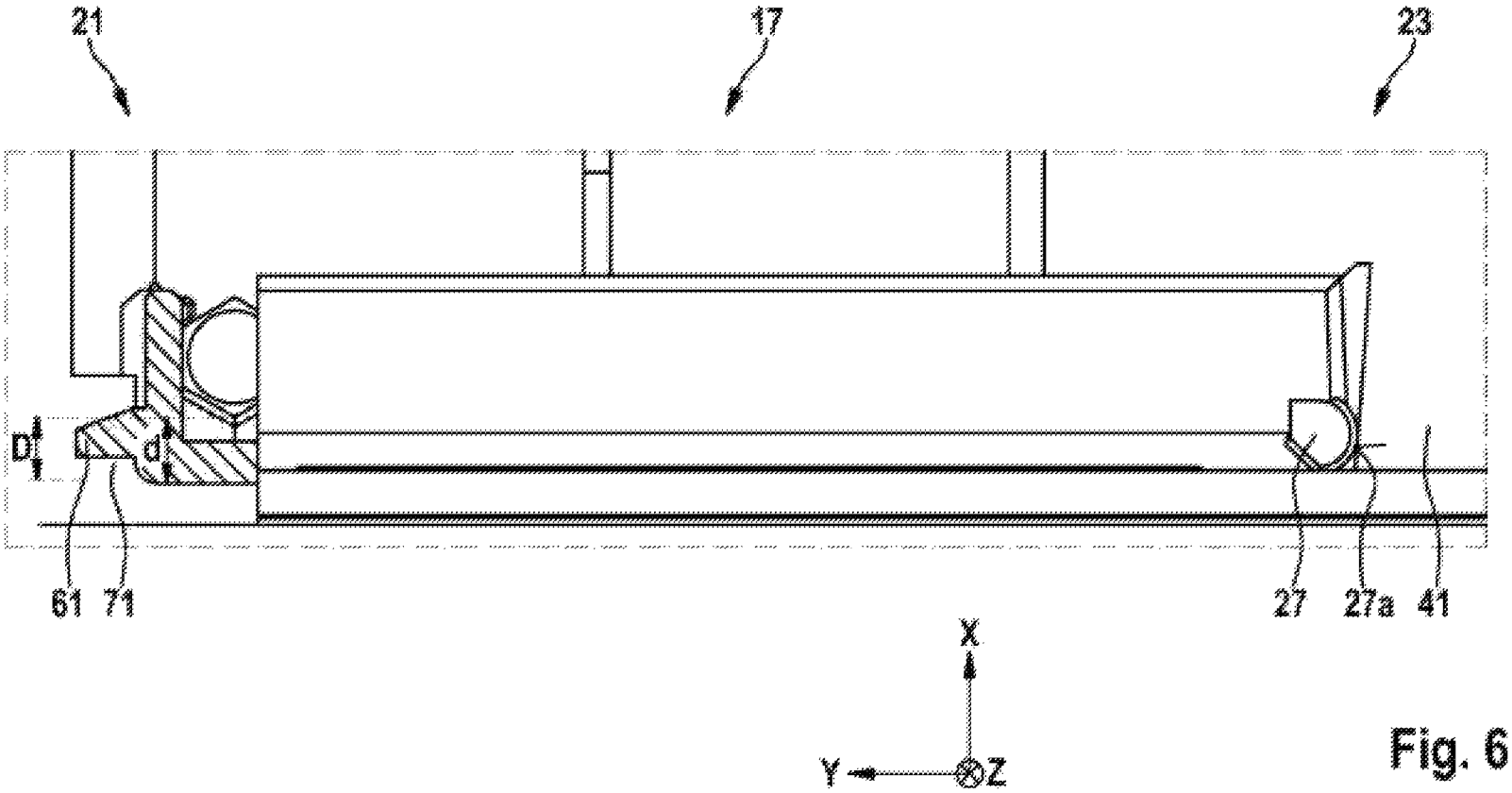
FIG. 6 shows a sectional view B-B of the plug-in means from FIG. 4.

FIG. 6 shows a section B-B through the plug-in means 13 and the storage housing 15 from FIG. 4. FIG. 6 shows the second holding end 2123 with a stop geometry 27, in particular a stop elevation, which is provided for the purpose of holding the plug-in means 13 with a precision fit in the receiving region 17. The stop geometry is realized in a cylindrical manner at least in part and comprises at least one stop surface pointing to the guide device 41. The stop surface 27*a*, in this case, is curved and comprises a curvature about the third direction Z such that the stop geometry 27, when the plug-in means 13 transfers from the release state into the fastened state, experiences a constraint force along the guide device 41, which constraint force clamps the plug-in means 13 in a fastened state in the receiving region 17 in at least the second direction Y of the storage housing 15.

The stop geometry 27 protrudes, in particular, in the third direction Z and defines the maximum extension of the plug-in means 13 in the third direction Z.

The stop geometry 27 protrudes in relation to the control surface of the control rib 57 in the third direction Z. The stop surface 27*a* defines the control rib surface 57*a* in the second direction Y. The stop surface 27*a* is arranged transversely to the control rib surface 57*a*. The stop geometry 27 is offset in at least the second direction Y in relation to the control rib surface 57*a* such that the stop geometry 27 provides a maximum extension of the plug-in means 13 in the second direction in a circumferential region of the plug-in means 13.

Figure 7:
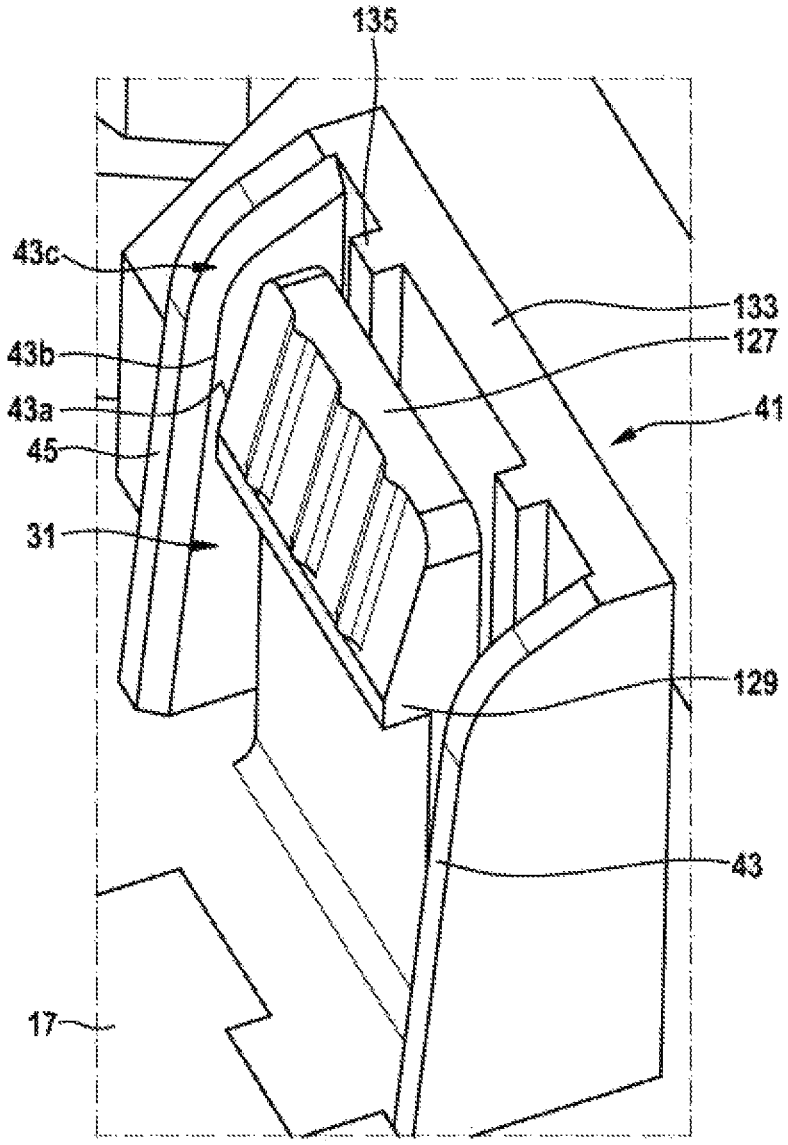
FIG. 7 shows a perspective view of the sectional view B-B of the plug-in means from FIG. 4.

FIG. 7 shows first latching geometry 31 and the guide device 41 which surrounds the first latching geometry 31 in a plane through at least 180°. The guide device 41 protects the first latching geometry 31 from an inadmissible load in at least the second direction Y. The guide device 41, in this case, comprises at least one support wall 133 which defines, and in particular connects, the guide ribs 43 in at least the second direction Y. The support wall 133, in this case, is arranged substantially between the two guide ribs 43. The support wall 133 extends in the third direction Z and protrudes in the first direction X from the bottom wall 107 of the receiving region 17. The support wall 133 comprises two defining ribs 135 which protrude toward the first latching geometry 31 in the second direction Y and define an, in particular elastic, movement of the first latching geometry 31, in particular of the latching arm 127, in the second direction Y.

The storage housing 15 comprises, on at least one of the side walls 105, a guide device 41, in particular a guide rib 43, which is provided for the purpose of exerting a constraint force on the plug-in means 13, in particular on the stop geometry 27 of the plug-in means 13, when the plug-in means 13 is transferred from a release state into a fastened state, in order to provide movement of the plug-in means 13 in at least the second direction Y.

The guide rib comprises a guide rib surface 43*a* which is spanned substantially in the first and in the second direction Y in order to enable the second holding end 23 of the plug-in means 13 to slide and to prevent movement of the plug-in means 13 in the third direction Z.

The guide rib additionally comprises a guide rib edge 43*b* which defines the guide rib surface 43*a* at least in the first and the second direction Y.

The latching arm 127 protrudes in the first direction X from the bottom wall 107 of the storage device 10 and comprises a latching shoulder 129 which extends in the second direction Y and is provided for the purpose of holding the second holding end 23, in particular the latching rib 53, of the plug-in means 13 in a positive locking manner between the latching shoulder 129 and the bottom wall 107 of the storage housing 15. The latching shoulder 129 is arranged on a side of the latching arm 127 remote from the support wall 133. The latching arm 127 is realized, in particular, as an elastic snap arm which, when the actuating force acts, is deflectable in at least the second direction Y and returns automatically into the initial position when the actuating force is terminated.

Figure 8:
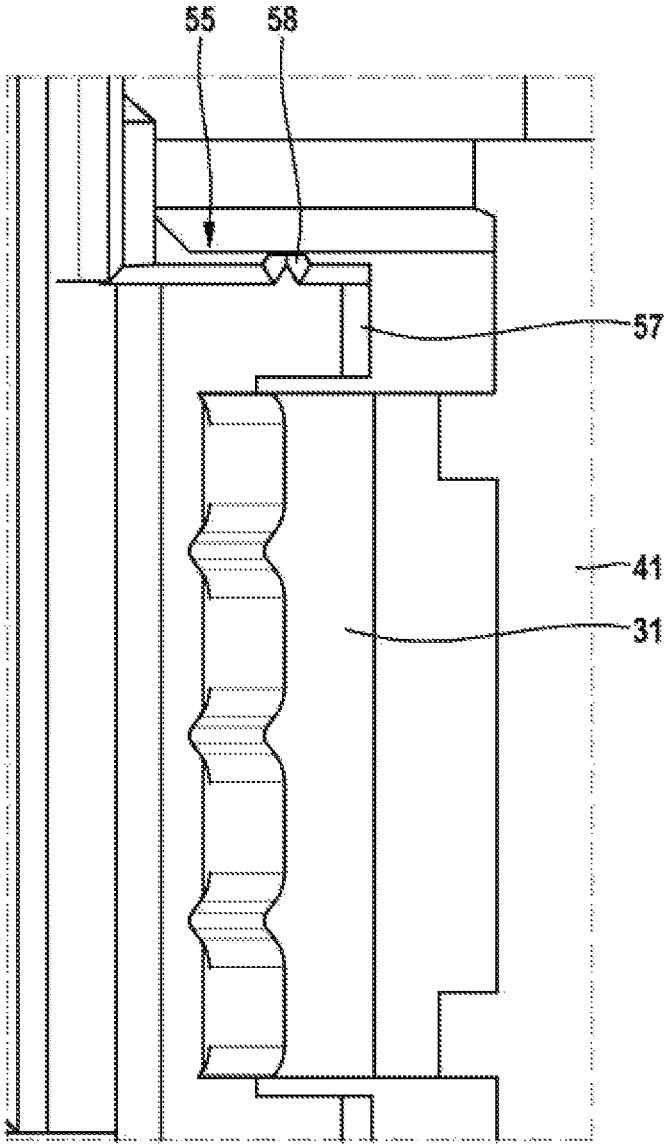
FIG. 8 shows a view of a latching device with a plug-in means situated in a fastened state in the latching device and FIG. 9 shows a perspective view of a first holding end of the plug-in means.

FIG. 8 shows the control rib 57 with an, in particular, elastic control elevation 57 which extends in the third direction Z and is provided for the purpose of mounting, in particular clamping, the plug-in means 13 in the receiving region 17 in at least the third direction Z in a fixed manner, in particular in play-free manner. The control elevation 57 is arranged on a side of the guide rib 43 remote from the first latching geometry 31.

The control ribs 57, in this case, define the extension of the second latching geometry 51 in the third direction Z on both sides.

Figure 9:
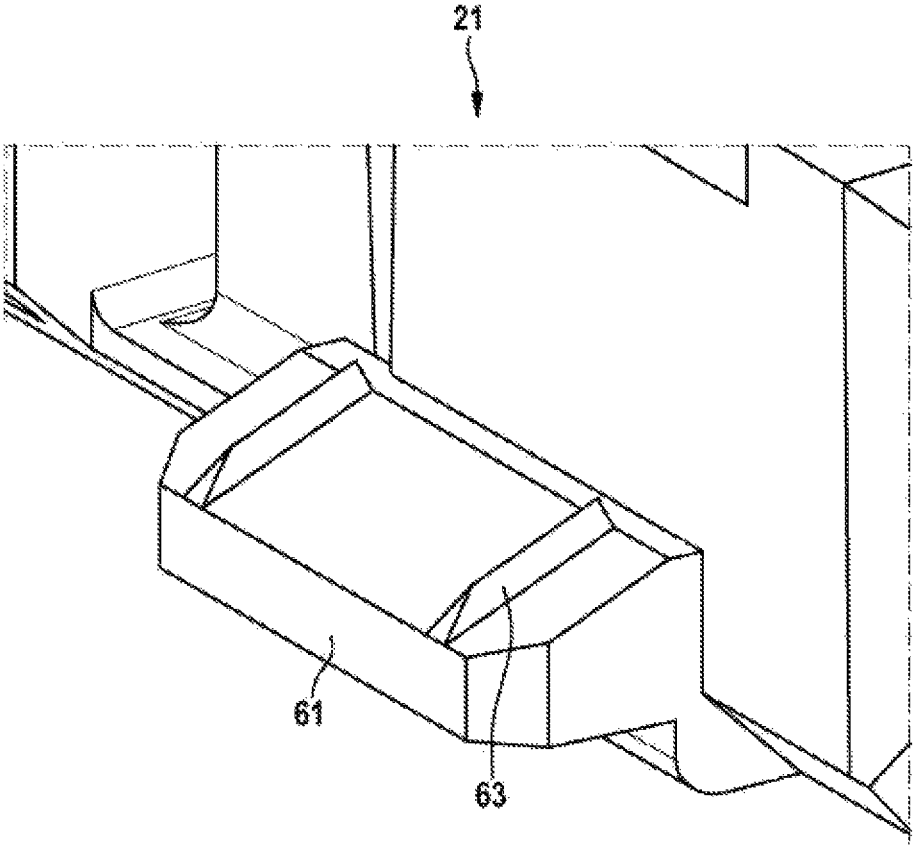

FIG. 9 shows a view of the first holding end 21 and of the holding tongue 61 of the first holding end 21. The holding tongue 61 preferably comprises multiple pretensioning elevations 63 which extend substantially in the second direction Y, protrude substantially in the first direction X and are provided for the purpose of compensating for tolerance differences between the holding tongue 61 and the storage housing 15 and of deforming elastically, when the holding tongue 61 is tensioned with at least part of the storage housing 15 at least in the first direction X and/or the second direction Y such that a pretensioning force, which acts substantially in the first direction X and/or in the second direction Y, acts on the holding tongue 61, in particular on the plug-in means 13. The pretensioning elevations 63 are realized in an oblong manner and define the extension of the holding tongue 61 in at least the first direction X.

The holding tongue 61 protrudes in the second direction Y and defines the maximum extension of the plug-in means 13.

The holding tongue 61, in particular the pretensioning elevations 63 of the holding tongue 61, can be provided for the purpose of generating pretension of the plug-in means 13 in a fastened state in the second direction Y.

As is shown, for example, in FIG. 6, the holding tongue 61 can be adapted to the recess 71 in the receiving region 17 in particular by means of an interference fit in such a manner that a force, in particular a pretensioning force, which acts at least in the first direction X, acts on the plug-in means 13, in particular on the holding tongue 61.

The invention claimed is:

1. A tool storage device for storing application tools and/or installation aids, comprising:

at least one plug-in member configured to hold application tools or installation aids, the at least one plug-in member including a first holding end and a second holding end; and at least one storage housing including a receiving region configured to releasably fasten the at least one plug-in member to the at least one storage housing, the at least one plug-in member configured such that, when in a fastened state in which the at least one plug-in member is fastened to the at least one storage housing, the first and second holding ends are aligned in a first direction and are at opposite ends of the at least one plug-in member in a second direction, which is perpendicular to the first direction, wherein, in the fastened state, the first and second holding ends are connected in a positive locking manner to the receiving region of the at least one storage housing so as to secure the at least one plug-in member in a positive locking manner in relation to the first direction, wherein the at least one plug-in member is connected to the at least one storage housing such that the at least one plug-in member is mounted in a fixed position on the at least one storage housing in the second direction, and wherein the at least one storage housing includes a first latching geometry that projects from a wall of the at least one storage housing in the first direction and the at least one plug-in member includes a second latching geometry, the first latching geometry configured, in the fastened state, to overlap with the second latching geometry in the second direction to positively lock the at least one plug-in member from movement in the first direction.

2. The tool storage device as claimed in claim 1, wherein:

the at least one plug-in member includes elastic material or is comprised of elastic material; and the at least one plug-in member is configured to deform at least in part at least in the second direction and configured to mount the at least one plug-in member in the receiving region in a fixed manner.

3. The tool storage device as claimed in claim 1, wherein the second holding end includes a stop geometry that extends in the first direction and is configured to mount the at least one plug-in member in a fixed manner in at least the second direction in the fastened state.

4. The tool storage device as claimed in claim 1, wherein the first latching geometry includes elastic material or is comprised of elastic material such that the first latching geometry deforms in the second direction to enable the second latching geometry to move in the first direction past the first latching geometry when the at least one plug-in member is moved into the fastened state or into the released state.

5. The tool storage device as claimed in claim 1, wherein the receiving region includes a guide device that interacts with a control geometry of the at least one plug-in member so as to exert a constraint force onto the at least one plug-in member in the second direction to guide the at least one plug-in member from the released state into the fastened state.

6. The tool storage device as claimed in claim 5, wherein the guide device surrounds the first latching geometry in a plane that extends along the second direction through at least 30° in order to protect the first latching geometry.

7. The tool storage device as claimed in claim 5, wherein the guide device includes at least one guide rib projecting in the first direction from the wall of the at least one storage housing and constraining movement of the at least one plug-in member in a third direction that is perpendicular to the first and second directions.

8. The tool storage device as claimed in claim 7, wherein the second holding end of the at least one plug-in member includes the control geometry, which extends in the second direction and is configured to interact with the at least one guide rib to position the at least one plug-in member along the guide device.

9. The tool storage device as claimed in claim 8, wherein the control geometry includes a control elevation protruding in the third direction and configured to interact with the at least one guide rib so as to constrain movement of the at least one plug-in member in the third direction.

10. The tool storage device as claimed in claim 1, wherein the first holding end of the at least one plug-in member includes a holding tongue projecting in the second direction, the holding tongue configured to engage in a recess defined in the receiving region of the at least one storage housing so as to restrain movement of the first holding end in the second direction and/or a third direction that is perpendicular to the first and second directions, and configured to clamp the first holding end of the at least one plug-in member in the first direction.

11. The tool storage device as claimed in claim 10, wherein the holding tongue is adapted via an interference fit to the recess in the receiving region such that force acting on the at least one plug-in member in the first direction are applied via the interference fit from the holding tongue to the receiving region at the recess.

12. The tool storage device as claimed in claim 11, wherein the holding tongue includes a pretensioning elevation configured to elastically deform in contact with the receiving region in the fastened state to apply a pretensioning force, which acts in the first direction, onto the holding tongue when the at least one plug-in member is in the fastened state.

13. The tool storage device as claimed in claim 1, wherein the tool storage device is a tool storage box.

14. The tool storage device as claimed in claim 1, wherein the first holding end and the second holding end of the at least one plug-in member are connected to the at least one storage housing such that the at least one plug-in member is clamped in a play-free manner on the at least one storage housing in the second direction.

15. The tool storage device as claimed in claim 7, wherein the at least one guide rib includes at least one inclined guide rib surface or at least one inclined guide rib edge that is oriented obliquely to the second direction so as to guide movement of the at least one plug-in member in the third direction when the at least one plug-in member is moved from the released state to the fastened state.

* * * * *